US005778654A

United States Patent [19]

Stahlecker

[11] Patent Number: 5,778,654

[45] Date of Patent: Jul. 14, 1998

[54] ADAPTOR FOR AN OPEN-END SPINNING DEVICE

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Suessen, both of Germany

[21] Appl. No.: 730,269

[22] Filed: Oct. 15, 1996

[30] Foreign Application Priority Data

Nov. 30, 1995 [DE] Germany ..... 195 44 617.8

[51] Int. Cl.[6] ..... D01H 4/00

[52] U.S. Cl. ..... 57/413; 57/407; 57/408; 57/414; 57/415

[58] Field of Search ..... 57/407, 408, 411, 57/412, 413, 414, 415

[56] References Cited

U.S. PATENT DOCUMENTS

| | | | |
|---|---|---|---|
| 3,411,283 | 11/1968 | Isomura | 57/407 X |
| 3,455,097 | 7/1969 | Rajnoha et al. | 57/411 X |
| 3,511,044 | 5/1970 | Stary | 57/411 |
| 3,523,300 | 8/1970 | Tabata et al. | 57/411 X |
| 4,069,655 | 1/1978 | Stahlecker et al. | 57/407 |
| 4,567,723 | 2/1986 | Safar | 57/411 X |
| 5,488,822 | 2/1996 | Meier | 57/407 |

FOREIGN PATENT DOCUMENTS

| | | | |
|---|---|---|---|
| 21 30 582B2 | 1/1973 | Germany . | |
| 42 22 840 A1 | 1/1994 | Germany . | |
| 43 34 485A1 | 4/1995 | Germany . | |
| 2204603 | 11/1988 | United Kingdom | 57/411 |
| WO79/00165 | 4/1979 | WIPO . | |
| WO94/01605 | 1/1994 | WIPO . | |

*Primary Examiner*—William Stryjewski
*Attorney, Agent, or Firm*—Evenson McKeown Edwards & Lenahan, PLLC

[57] ABSTRACT

An adaptor in the form of an exchangeable extension adapted to the dimensions of an open end spinning rotor and in use is detachably connected with a spinning rotor cover. The adaptor comprises the first part of a yarn withdrawal channel as well as the end area of a fiber feed channel. The end area of the fiber feed channel continues the connecting part of the fiber feed channel located outside of the adaptor with a partioning joint. The transition from the connecting piece to the end area of the fiber feed channel is buckle-free or bend free. The end area of the fiber feed channel located in the adaptor has a curved area, which is also buckle-free or bend free. This curved area corresponds to the rotational direction of the spinning rotor and also comprises a component in axial direction of the spinning rotor. The curved area preferably extends with a constant radius over the entire adaptor.

20 Claims, 2 Drawing Sheets

ADAPTOR FOR AN OPEN-END SPINNING DEVICE

BACKGROUND AND SUMMARY OF THE INVENTION

The present invention relates to an adaptor for an open-end spinning device, which adaptor is adapted to the dimensions of a spinning rotor and which is arranged as an exchangeable lid extension to a cover of the spinning rotor. The adaptor comprises the first section of a yarn withdrawal channel as well as the end area of a fiber feed channel, whereby this end area has a fiber transport direction at least at its outlet opening which deviates from the fiber transport direction of a connecting piece of the fiber feed channel located outside of the adaptor.

An adaptor of this type was shown at the International Textile Machines Exhibition (ITMA) in Milan in 1995. The adaptor used was assembled in a spinning device marked SE 10 in an open-end spinning machine with the name Autocoro from the firm Schlafhorst. The adaptor corresponds to the adaptor disclosed in the German published patent application DE 43 34 485 Al with the additional feature that the fiber transport direction in the end area of the fiber feed channel is altered. In that adaptor, the end area of the fiber feed channel continues the connecting part, located outside of the adaptor, of the fiber feed channel with a distinctive buckle or bend.

The buckle or bend on the joint of the prior art adaptor leads to an increased friction of the fibers along the wall of the fiber feed channel, whereby the fibers are slowed down somewhat. When the fibers reach the fiber sliding surface of the spinning rotor with their front parts, they are accelerated in a new direction. A certain pulling effect arises, as the spinning rotor pulls the fibers out of the outlet opening of the fiber feed channel and thereby drafts them. It has been shown that, due to the buckle or bend in the fiber feed channel, the yarn quality improves, while however the spinning stability deteriorates. It is mainly piecing that presents difficulties.

A piston-like cylindrical adaptor, which is known from FIGS. 7 and 8 of German published examined application 21 30 582, is assembled in the cover of the spinning rotor and held by an attachment screw. The end area of the fiber feeding channel located in the adaptor is linear. There is also no buckle or bend of the fiber feed channel on the actual point between the adaptor and the connecting piece, located outside of the adaptor. Rather, a buckle or bend is to be found at a certain distance from the joint in the connecting piece of the fiber feed channel A ring-shaped adaptor piece placed on the lid extension is known from the international patent application WO 79/00165. This ring-shaped adaptor piece comprises a radial bore hole which extends the fiber feed channel, so that when the spinning rotor is being changed, the position of the outlet opening of the fiber feed channel can be matched to the fiber sliding surface of the spinning rotor. The radial bore hole begins with a distinctive buckle or bend at the partitioning joint to the connecting piece of the fiber feed channel. A first section of the yarn of the fiber feed channel. A first section of the yarn withdrawal channel is not present in the ring-shaped adaptor Piece.

From the international patent application WO 94/01605 an adaptor is known from FIGS. 15 to 20 which borders a wall of a loophole-like outlet opening of the fiber feed channel. The other wall is formed by the cover itself. The end area of the fiber feed channel is buckled one or more times.

From German published patent application 42 22 840 Al, a continuous fiber feed channel without an adaptor and without any partitioning joint is known, whereby the mouth area of the fiber feed channel is curved in the rotational direction of the rotor with the aim of achieving a more plane angle of impact of the fibers with the fiber sliding surface of the spinning rotor.

It is an object of the present invention to achieve a higher spinning stability without impairing the improved yarn quality with an adaptor of the above mentioned kind.

The object has been achieved in accordance with the present invention in that the end area of the fiber feed channel extends its connecting piece without any buckles or bends and comprises a buckle-free curve.

As a result of the gentler curve of the end area of the fiber feed channel, the fibers are not so much abruptly braked, curvatures can be set into the cover according to whatever fibers are to be spun. The radius of the curve can be of a varying size, depending on the size of the chosen adaptor. If the radius is small, the friction of the fibers is increased, and they are condensed more. On the other hand, if the radius is enlarged, the gliding-along of the fibers on the fiber feed channel wall is facilitated, but their bundling is accordingly reduced. A tight bundling can be advantageous in some cases, in others not so. The adaptor possesses the advantage of being adaptable to the type of fiber material used.

The fibers exiting from the outlet opening of the fiber feed channel are transferred in a particular arrangement onto the fiber sliding surface of the spinning rotor when the curve of the end area of the fiber feed channel corresponds to the direction of rotation of the spinning rotor. Larger deflections from the desired direction are thus avoided. The concave side of the curve should hereby face the axis of the spinning rotor.

The curve does not extend on one plane, depending on how far the adaptor projects into the inside of the spinning rotor. Rather, it can comprise a component in axial direction of the spinning rotor.

When the curve has a constant radius and extends over the entire end area of the fiber feed channel, that is over the entire adaptor, a tool with a curved sleeve can be realized. After the adaptor has been molded, the curved sleeve can be pulled out in a circular movement from the work piece. It is hereby practical when, in the area of the curve, the cross section of the fiber feed channel decreases in the direction towards the outlet opening.

The starting cross section of the end area of the fiber feed channel advantageously overlaps the end cross section of the connecting piece of the fiber feed channel. In the case of such a "positive cross over" in fiber transport direction, impact of the fibers on the partitioning joint is avoided.

The invention can be realized for varying cross sections of the end area of the fiber feed channel. A cross section is hereby practical which condenses the flow of fibers and thus guides the fibers more tightly. The fiber feed channel can advantageously comprise a fiber guiding groove on the outer radius of its curvature. The fibers are thus transported in the fiber guiding groove, while the larger sectional area at the smaller radius of the curvature receives the benefit of an increased, fiber-free air flow. The fibers can be guided accurately into the spinning rotor while a large mouth cross section for the desired high air flow is maintained.

These and further objects, features and advantages of the present invention will become more readily apparent from the following detailed description thereof when taken in conjunction with the accompanying drawings.

DETAILED DESCRIPTION OF THE DRAWINGS

Figure 1:
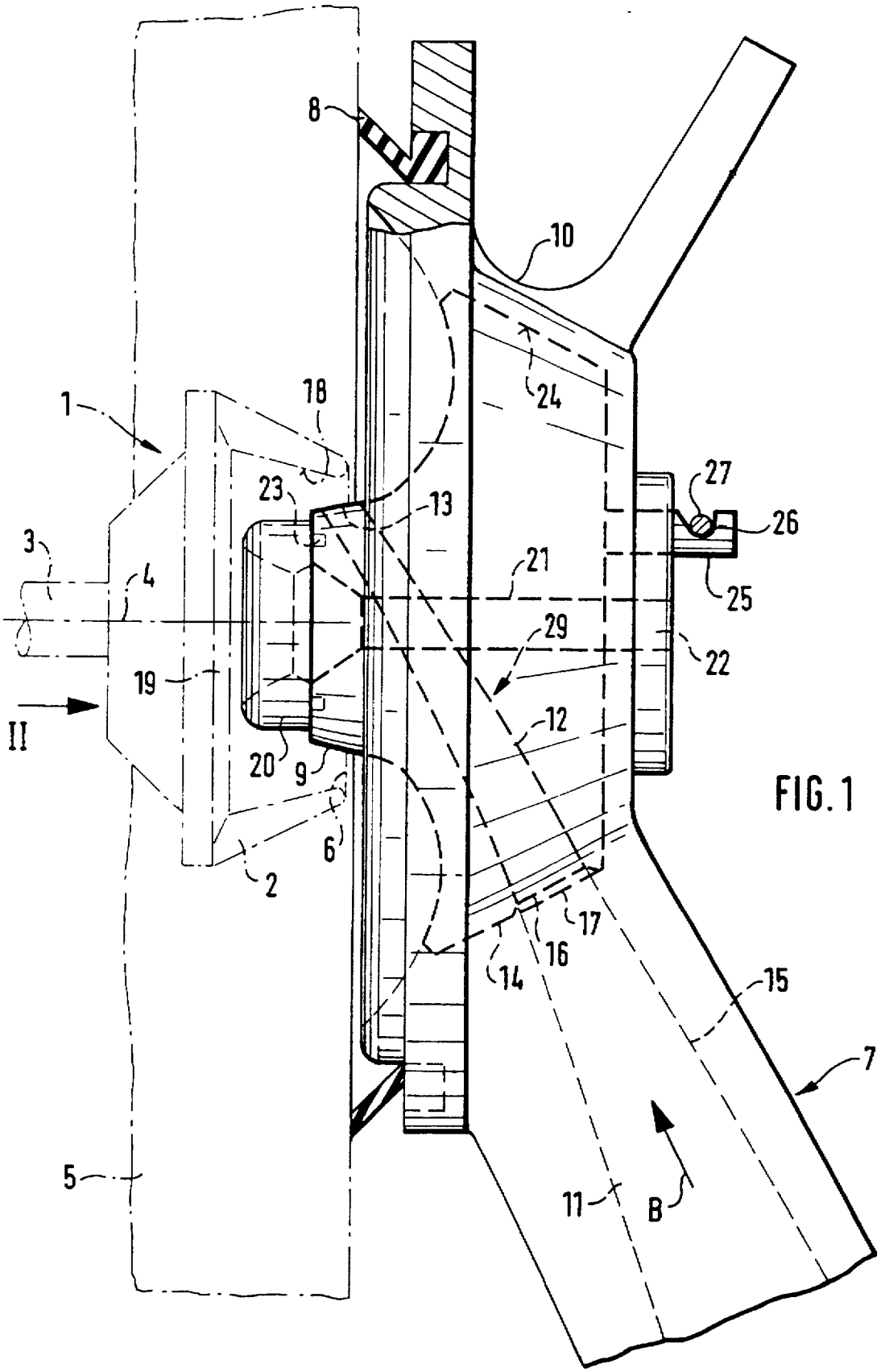
FIG. 1 is a partly sectional side view of a cover of a spinning rotor with an adaptor according to the present invention, whose contours are marked out by bold lines.

The spinning rotor 1 is shown by dot-dash lines in all the Figures. It comprises in the known way a rotor cup 2 and a shaft 3, which are supported and driven in a way not shown here. The spinning rotor 1 rotates on its axis 4 in direction During operation, the rotor cup 2 rotates in a known way inside of a vacuum rotor housing 5 shown also by dot-dash lines. The open front side 6 of the rotor cup 2 is closed off during operation by a cover 7 which can be moved aside for maintenance purposes. A washer 8 provides a seal between the cover 7 and the rotor housing 5.

An adaptor 9 in the form of an exchangeable lid extension is arranged on the cover 7, which adaptor 9 partly projects into the inside of the rotor cup 2. A finger groove 10 applied to the cover 7 enables the covered 7 to be moved away from the rotor housing 5 while at the same time enabling the removal of the adaptor 9 from the spinning rotor 1.

A fiber feed channel 11 is arranged in the cover 7, which fiber feed channel 11 extends from an opening roller (not shown) to the rotor cup 2. The fiber transport direction is denoted by the letter B. The fiber transport itself takes place in a known way with the aid of generated vacuum.

The end area 12 of the fiber feed channel 11 facing the rotor cup 2 is arranged in the adaptor 9. The outlet opening 13 of the fiber feed channel 11 projects into the inside of the rotor cup 2. By means of a partitioning joint 14, the end area 12 of the fiber feed channel 11 adjoins a connecting piece 15 of the fiber feed channel 11, which connecting piece 15 is located outside of the adaptor 9. The transition at the partitioning joint 14 between the connecting piece 15 and the end area 12 of the fiber feed channel 11 is such that the starting cross section 16 of the end area 12 overlaps the end cross section 17 of the connecting piece 15.

The outlet opening 13 of the fiber feed channel 11 is disposed at a short distance opposite a fiber sliding surface 18 of the rotor cup 2. The fiber sliding surface 18 widens conically, starting at the open front side 6 of the rotor cup 2, towards a fiber collecting groove 19, where the fibers, fed onto the fiber sliding surface 18, slide in a known way and there collect to form a fiber ring. The yarn formed in the fiber collecting groove 19 is drawn off in a known way through a yarn withdrawal navel 20, which is arranged at the adaptor 9 coaxially to the axis 4 of the spinning rotor 1. Besides the end area 12 of the fiber feed channel 11, the adaptor 9 also comprises the starting area 21 of a yarn withdrawal channel 22. The yarn withdrawal navel 20 is itself held on the adaptor 9 by means of a plurality of permanent magnets 23.

The adaptor 9 comprises on its side not facing the yarn withdrawal navel 20 a conical stopping surface 24 which tapers backwards and with which the adaptor 9 is held free from play on the cover 7. The adaptor 9 has a bolt extension 25, which is placed through a corresponding bore hole of the cover 7. This bolt extension 25 is disposed outside of the axis 4, but parallel thereto, so that by this the adaptor 9 can be secured in a predetermined position. The bolt extension 25 comprises a holding notch 26 outside of the cover 7, into which holding notch 26 an operating bow 27, arranged diagonally to the axis 4, engages. The operating bow 27 can be a wire-like hand lever, which is placed on a holder 28 and inserted in the holding notch 26 to secure the adaptor 9. The adaptor 9, with its conical stopping surface 24, is thereby drawn securely backwards to the cover 7.

As already described, the adaptor 9 is formed as an exchangeable lid extension. The reason that it is exchangeable is to enable the adaptation of the end area 12 of the fiber feed channel 11 to different fiber materials as well as to different dimensions of the rotor cup 2 of the spinning rotor 1. A particular object of the present invention is to be able to match the adaptor 9 to different diameters of the rotor cup 2. The purpose of the present invention is to avoid inadequate compromise solutions with regard to fiber feeding for the benefit of a good yarn quality.

As mentioned in the introductory part of the description, a certain change in the fiber transport direction B in the fiber feed channel 11 is advantageous, insofar as such a change is not made exclusively for purely geometrical reasons. However, in order not to reduce the spinning stability, that is, in order not to have the risk of an increased number of end breaks, the change of the fiber transport direction B must be effected as smoothly as possible. For this reason, the end area 12 of the fiber feed channel 11 is joined buckle-free or bend-free to the connecting piece 15, and, in addition, the end area 12 is provided with a buckle-free or bend-free curve 29. The fibers can hereby be advantageously lightly braked without being unduly crimped.

Figure 2:
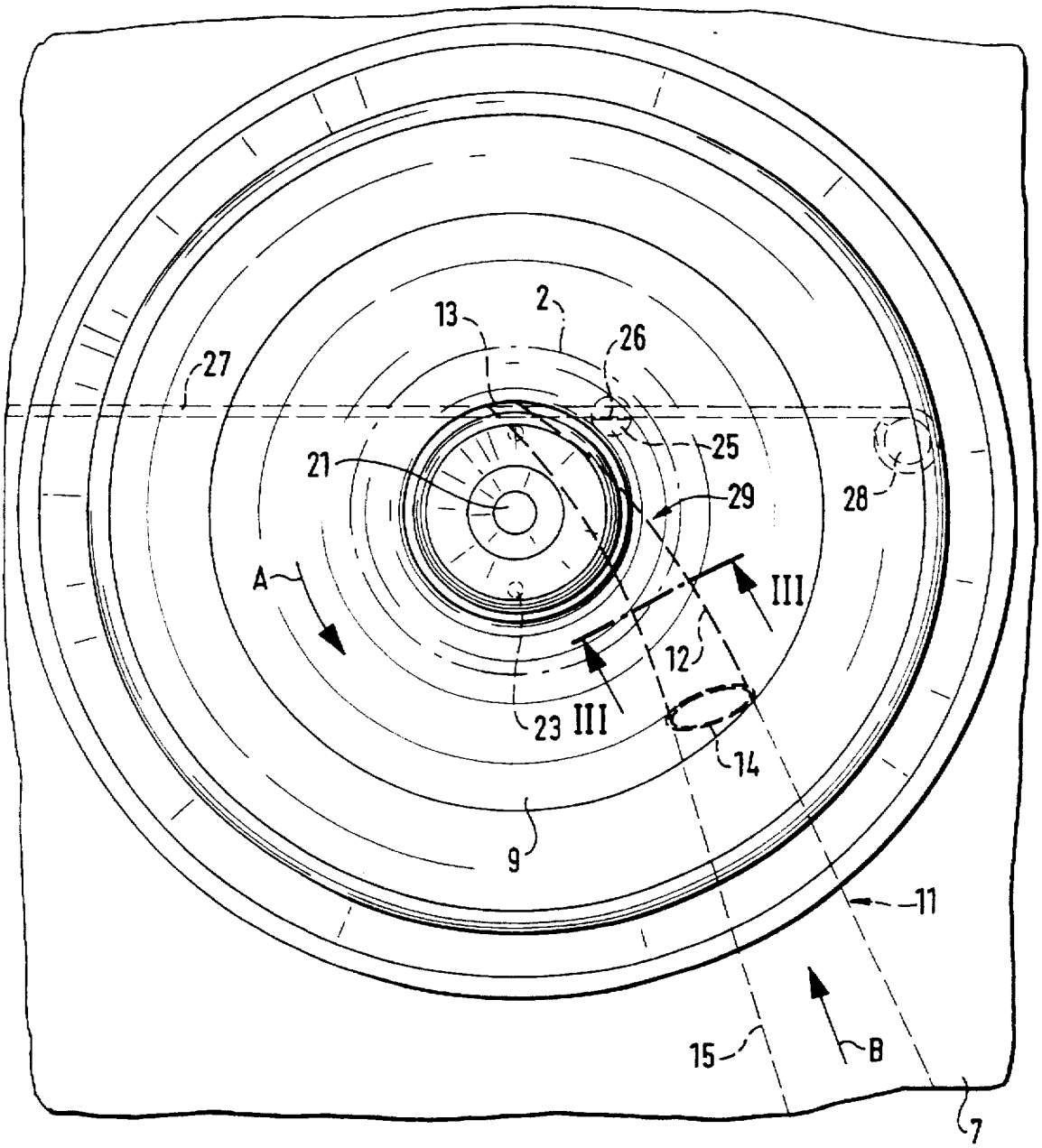
FIG. 2 is a view in the direction of arrow II of FIG. 1 of the area of the adaptor, whose contours are also marked by bold lines.

The curve 29 of the end area 12 of the fiber feed channel 11 located in the adaptor 9 extends in rotation direction A of the spinning rotor 1, whereby the concave side of the curve 29 faces the axis 4 of the spinning rotor 1. A component of the curve 29 extends hereby in axial direction of the spinning rotor 1, so that the curve 29 extends entirely as a spatial curve, which deviates from the projections in FIGS. 1 and 2. It is practical for technical reasons of production that the curve 29 has a constant radius and extends over the entire area of the adaptor 9. Furthermore, in the area of the curve 29, the diameter of the fiber feed channel 11 continuously decreases towards the outlet opening 13.

Figure 3:
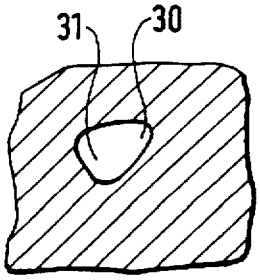
FIG. 3 is a cross section through the end area of the fiber feed channel along the cutting plane III—III of FIG. 2.

According to FIG. 3, the end area 12 of the fiber feed channel 11 is advantageously provided on the outer radius of its curve 29 with a fiber guiding groove 30, where the fed fibers preferably collect. The cross section of the fiber feed channel 11 thus has an enlarged fiber-free area 32, which serves first and foremost the transport of the required volume of spinning air.

An adaptor 9 can, of course, be made without the use of a sleeve, by, for example, injecting a curved tube into an adaptor 9 made of plastic. The curved tube could be made of glass or ceramic material. The tube comprising the curve 29 could, if required, be subsequently pushed into, clipped or adhered to the adaptor 9.

With respect to the fiber guiding groove 30, it is possible to make it larger in radius at the start of the curve 29 than in the area of the outlet opening 13. Alternatively, the fiber guiding groove 30 can begin first near the outlet opening 13.

It is further possible to make the end area 12 of the fiber feed channel 11 in the form of a helical line. This can also contribute to the braking of the fibers or if required, it can give a twist to the transport air, which has an effect on the fiber formation. In such a case, the sleeve could be removed from the finished work piece in a screw movement.

A channel piece comprising the curve 29 and injected into the actual adaptor 9 could comprise an internal coating or could itself be made from particularly resistant material. The area of the fiber guiding groove 30, insofar as one is present, should be well polished.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An adaptor for an open-end spinning arrangement adapted to the dimensions of a spinning rotor and arranged in use as an exchangeable extension at a cover of the spinning rotor and comprising a starting area of a yarn withdrawal channel as well as an end area of a fiber feed channel, said end area having an outlet opening having a fiber transport direction which deviates from a fiber transport direction of a connecting piece of the fiber feed channel located outside of the adaptor, wherein said end area of the fiber feed channel continues said connecting piece in a continuous curve along its entire length to thereby minimize braking forces on fibers supplied through the fiber feed channel.

2. An adaptor according to claim 1, wherein the curve corresponds to the direction of rotation of the spinning rotor.

3. An adaptor according to claim 2, wherein the concave side of the curve faces the axis of the spinning rotor.

4. An adaptor according to claim 3, wherein the curve comprises a component in axial direction of the spinning rotor.

5. An adaptor according to claim 3, wherein the curve has a constant radius.

6. An adaptor according to claim 3, wherein the curve extends over the entire end area of the fiber feed channel.

7. An adaptor according to claim 3, wherein the cross section of the fiber feed channel in the area of the curve continuously decreases towards the outlet opening.

8. An adaptor according to claim 3, wherein the starting cross section of the end area of the fiber feed channel overlaps the end cross section of the connecting piece of the fiber feed channel.

9. An adaptor according to claim 1, wherein the concave side of the curve faces the axis of the spinning rotor.

10. An adaptor according to claim 1, wherein the curve comprises a component in axial direction of the spinning rotor.

11. An adaptor according to claim 1, wherein the curve has a constant radius.

12. An adaptor according to claim 1, wherein the curve extends over the entire end area of the fiber feed channel.

13. An adaptor according to claim 1, wherein the cross section of the fiber feed channel in the area of the curve continuously decreases towards the outlet opening.

14. An adaptor according to claim 1, wherein the starting cross section of the end area of the fiber feed channel overlaps the end cross section of the connecting piece of the fiber feed channel.

15. An adaptor according to claim 1, wherein the fiber feed channel has a fiber guiding groove on the outer radius of its curve.

16. An adaptor according to claim 15, wherein the starting cross section of the end area of the fiber feed channel overlaps the end cross section of the connecting piece of the fiber feed channel.

17. An adaptor insert configured to be selectively exchangeably connected with an open-end spinning rotor cover having a cover fiber feed channel which in use accommodates transfer of fibers from a fiber opening device, said adaptor insert including an adaptor fiber feed channel extending therethrough which in use extends from the cover fiber feed channel to an outlet opening facing a spinning rotor, wherein the adaptor fiber feed channel is configured to form a continuous curve along its entire length in the adaptor and extending through a transitional region connecting with the cover fiber feed channel thereby minimizing braking forces on fibers passing through said cover fiber feed channel and said transitional region.

18. An adaptor insert according to claim 17, wherein the continuous curve in said fiber feed channel extends with a substantially constant radius over its length from the transitional region to the outlet opening.

19. An open-end rotor spinning unit assembly comprising:

a rotor housing, a spinning rotor rotatably supported in said rotor housing, a cover covering said rotor housing at an axial end facing an open end of said spinning rotor, said cover having a cover fiber feed channel accommodating feeding of fibers from a fiber opening device, and an exchangeable adaptor insert connected with and carried by said cover, said adaptor insert including an adaptor fiber feed channel extending therethrough which in use extends from the cover fiber feed channel to an outlet opening facing the spinning rotor, wherein the adaptor fiber feed channel is configured to form a continuous curve along its entire length extending through a transitional region connecting with the cover fiber feed channel thereby minimizing braking forces on fibers passing through said cover fiber feed channel and said transitional region.

20. A spinning unit assembly according to claim 19, wherein said continuous curve has a substantially constant radius over the length of the adaptor fiber feed channel.

* * * * *